US012281450B2

(12) United States Patent
Buschmann et al.

(10) Patent No.: US 12,281,450 B2
(45) Date of Patent: Apr. 22, 2025

(54) METHOD FOR ADJUSTING A TEMPERATURE OF A SCREED PLATE OF A PAVING SCREED OF A ROAD PAVER

(71) Applicant: JOSEPH VOEGELE AG, Ludwigshafen/Rhein (DE)

(72) Inventors: Martin Buschmann, Neustadt (DE); Roman Munz, Neustadt (DE); Ralf Weiser, Ladenburg (DE); Dennis Hanfland, Speyer (DE)

(73) Assignee: Joseph Voegele AG, Ludwigshafen/Rhein (DE)

( * ) Notice: Subject to any disclaimer, the term of this patent is extended or adjusted under 35 U.S.C. 154(b) by 745 days.

(21) Appl. No.: 17/411,360

(22) Filed: Aug. 25, 2021

(65) Prior Publication Data

US 2022/0064874 A1 Mar. 3, 2022

(30) Foreign Application Priority Data

Aug. 27, 2020 (EP) ..... 20193017

(51) Int. Cl.
*E01C 19/08* (2006.01)
*E01C 19/48* (2006.01)

(52) U.S. Cl.
CPC ..... *E01C 19/08* (2013.01); *E01C 19/4866* (2013.01); *E01C 2301/10* (2013.01)

(58) Field of Classification Search
CPC ... E01C 19/08; E01C 19/4866; E01C 2301/10
USPC ..... 404/75, 77, 79, 84.05–84.5, 95, 118
See application file for complete search history.

(56) References Cited

U.S. PATENT DOCUMENTS

| | | | |
|---|---|---|---|
| 9,447,549 B2 | 9/2016 | Buschmann et al. | |
| 10,550,528 B2 | 2/2020 | Thiesse | |
| 2019/0136466 A1* | 5/2019 | Thiesse | H05B 1/023 |

FOREIGN PATENT DOCUMENTS

| | | |
|---|---|---|
| CN | 105133470 A | 12/2015 |
| CN | 110042732 A | 7/2019 |
| DE | 199 06 070 C1 | 6/2000 |
| DE | 10 2015 014674 A1 | 5/2017 |
| DE | 10 2018 127353 A1 | 5/2019 |
| EP | 1 028 195 A2 | 8/2000 |
| EP | 1 295 990 B1 | 9/2008 |
| EP | 2 789 740 A1 | 10/2014 |
| EP | 3 051 024 A1 | 8/2016 |
| JP | 2014206043 A | 10/2014 |

(Continued)

OTHER PUBLICATIONS

European Search Report Dated Feb. 25, 2021, Application No. 20193017.9-1002, Applicant Joseph Voegele AG, 7 Pages.

(Continued)

*Primary Examiner* — Raymond W Addie
(74) *Attorney, Agent, or Firm* — Brooks Kushman P.C.

(57) ABSTRACT

A method is provided for adjusting a temperature of a screed plate of a paving screed of a road paver, wherein the paving screed comprises a heating element for heating the screed plate. The method may include measuring temperature of the screed plate over a time interval using a temperature sensor, and adjusting a target temperature of the heating element, depending on a time profile of the temperature of the screed plate, using a control unit of the road paver.

19 Claims, 4 Drawing Sheets

(56) References Cited

FOREIGN PATENT DOCUMENTS

WO WO-0047822 A1 * 8/2000 ..... E01C 19/48

OTHER PUBLICATIONS

Indian Examination Report Dated Mar. 7, 2022, Application No. 202144037613, 6 Pages.
Chinese Search Report (with English Machine Translation) Dated Sep. 21, 2022, Application No. 202110990059.X, 6 Pages.
Chinese Office Action (with English Machine Translation) Dated Sep. 27, 2022, Application No. 202110990059.X, 18 Pages.
Japanese Office Action JP Application No. 2021-136275 dated Feb. 4, 2025, English machine translation.
JP 2014206043 A, US 9,447,49 B2.
Japanese Office Action, JP Patent Application No. 2021-136275, Applicant: Joseph Voegele AG, Feb. 4, 2025 (with English machine translation) (14 pages).

* cited by examiner

METHOD FOR ADJUSTING A TEMPERATURE OF A SCREED PLATE OF A PAVING SCREED OF A ROAD PAVER

CROSS-REFERENCE TO RELATED APPLICATIONS

This application claims foreign priority benefits under 35 U.S.C. § 119(a)-(d) to European patent application number EP 20193017.9, filed Aug. 27, 2020, which is incorporated by reference in its entirety.

TECHNICAL FIELD

The present disclosure relates to a method for adjusting a temperature of a screed plate of a paving screed of a road paver according to the preamble of claim 1, as well as to a method for adjusting a temperature of a screed plate of a paving screed of a road paver according to the preamble of claim 5, and a road paver for laying material onto a subgrade.

BACKGROUND

Road pavers and corresponding methods also for adjusting the temperatures of the usually provided paving screeds and screed plates, respectively, are sufficiently known from the prior art. Such methods are usually used to guarantee a temperature of the screed plate that will ensure reliable laying of the material for paving the road and at the same time prevent excessive heating of the material.

DE 10 2018 127 353 A1, for example, discloses a system for controlling the heating of a screed plate, in which the temperature of the material along its delivery path from the material hopper into the paving screed is measured. On the basis of this temperature, which corresponds to the actual temperature of the paving material, the control unit, while carrying out a comparison with the temperature values measured by a further temperature sensor for the screed plate, operates a heater so as to maintain the screed plate temperature within a temperature variation range relative to an otherwise estimated paving material temperature.

By providing various sensors, the method disclosed in this document allows to estimate the paving material temperature and to thus precisely control in a closed loop the control of the heater. On the other hand, it is thus necessary to use many sensors, and this increases the possibility of malfunction in the event that one or more sensors should fail. In addition, since the sensors that measure the temperature of the paving material are independent of the sensors that measure the screed plate temperature, and since both said temperature measurements are necessary for operation, there is no redundancy in these sensors, so that the failure of even only one of the respective types of sensors will impede the execution of the method.

In addition, the control unit must receive and process a very large number of inputs, so that the number of interfaces is high and the control unit is therefore complex.

SUMMARY

Taking the known prior art as a basis, the technical task to be solved is seen in a method for heating a screed plate of a paving screed of a road paver, which achieves a reduced susceptibility to errors while making use of a smaller number of components.

A method for adjusting a temperature of a screed plate of a paving screed of a road paver according to the present disclosure is characterized in that the paving screed comprises a heating element heating the screed plate and a temperature sensor measuring the temperature of the screed plate over a time interval, and that the road paver comprises a control unit which, depending on a time profile of the temperature of the screed plate, adjusts a target temperature of the heating element.

Advantageously, this method does not necessitate the use of a sensor for directly measuring the temperature of the material applied to the subgrade by the paving screed of the road paver (road surface). This means that there is no need to provide a sensor which is specially configured for measuring the temperature of the material. The present disclosure is so conceived that, due to a heat exchange between the screed plate and the material to be heated by the screed plate, the temperature profile of the screed plate is changed depending on the material temperature, and this allows conclusions to be drawn with respect to the material temperature while the temperature of the screed plate is known. A desired target temperature of the screed plate and consequently the heating power can thus be adjusted in an advantageous manner, without a precise determination of the temperature of the material being necessary, a circumstance that reduces the number of components required.

According to an embodiment, the screed plate may be heated to a first temperature by the heating element and the heating element may subsequently be deactivated and the screed plate brought into contact with material that is being laid onto a subgrade, a material temperature being determined by the control unit from the time profile of the temperature of the screed plate after deactivation of the heating element and the target temperature being determined depending on the material temperature.

This embodiment takes advantage of the fact that the screed plate will cool down on contact with the material, when it has been heated to a high temperature. This cooling takes place according to known physical laws and thus allows conclusions to be drawn with respect to the temperature of the material when the temperature of the screed plate is known. Hence, also in this case the temperature of the material need not be determined with the aid of a sensor or other means.

According to another embodiment, the heating element may heat the screed plate to a heat-up temperature, which is lower than a material temperature of the material that is being laid onto a subgrade, and, subsequently, the screed plate may be brought into contact with the material while the heating element heats the screed plate, the material temperature being determined by the control unit from the time profile of the temperature of the screed plate while the latter is being heated by the heating element and is in contact with the material, and the target temperature being determined depending on the material temperature.

In this embodiment, it is possible to determine the point in the time profile of the temperature of the screed plate at which an additional heat transfer from the material to the screed plate no longer takes place because the temperature of the screed plate is above the temperature of the material. This allows conclusions to be drawn with respect to the temperature of the material, which, in turn, allows the target temperature of the heater to be determined without precise knowledge of the material temperature.

According to an embodiment, the control unit determines the target temperature from the material temperature by increasing the material temperature by a differential value.

This will ensure that the temperature of the screed plate is always above the material temperature determined. This is particularly important if the screed heating either operates in a cyclic mode, and the screed plate is therefore not heated periodically. The control unit will here deactivate the heating element when the target temperature of the screed plate has been reached and will supply the heating element with power again after the screed plate has cooled down to material temperature.

The differential value can be regarded as an "offset" and can thus be used e.g., for keeping the temperature of the screed as far as possible always above or at least equal to the material temperature. This will prevent undesired adhesion of the paving material.

An alternative method for adjusting a temperature of a screed plate of a paving screed of a road paver is characterized in that the paving screed comprises a heating element heating the screed plate, and the road paver comprises a control unit, the control unit determining the target temperature of the screed plate taking into account an operating parameter of the road paver and/or of the surroundings and/or of the road surface.

The term "operating parameter" of the road paver, of the surroundings or of the road surface refers to values that are already determined during normal operation of the road paver, e.g., the road surface temperature, the material temperature upon delivery or the like. For example, when the road is scanned behind the road paver, it is common practice to record the surface temperature of the road with the material laid on it and thus in particular the temperature of the material laid on the ground. Suitable means are usually provided independently of the sensors of the paving screed. For determining a necessary temperature of the screed plate, it will then be possible to use the temperature determined for the laid material, e.g., by taking into account that the temperature of the material before laying and while the material is in contact with the screed plate of the paving screed is slightly higher than the temperature of the material which has already been laid, this temperature being measured during the scan. In particular for simplifying the calculation, it can here be assumed that the temperature of the laid material (determined by the scan) is equal to the material temperature $T_{mat}$ in the area of the paving screed, especially on contact with the screed plate. The target temperature of the screed plate of the paving screed can then be defined as a value $T_{mat}+\Delta T$, where $\Delta T>0K$ can be a temperature offset chosen to avoid adhesion of the material to the paving screed.

The use of respective operating parameters for determining the target temperature also allows to provide a system that is more compact with respect to hardware demands, since there is no need to provide additional sensors.

The taking into account of the operating parameters is here to be understood in such a way that, contrary to the above-described embodiments, it may be possible to dispense with more far-reaching calculations, but determine the material temperature directly from the values generally described as "operating parameters", and to determine on this basis (e.g., by adding a temperature offset, as described hereinbefore) the target temperature of the screed plate.

According to an embodiment, the operating parameter of the road surface comprises a surface temperature of the road surface, which has been determined during a temperature scan. The surface temperature of the road surface may be measured in particular in the direction of travel of the vehicle behind the vehicle and characterizes thus the temperature of the material just laid, which temperature has already been described hereinbefore, whereby the material temperature is known (within certain limits or with a certain accuracy).

This realizes a preferred variant of this embodiment and, assuming a temperature that remains constant between contact with the screed plate and measurement behind the vehicle, allows the material temperature to be determined directly and thus economically with respect to the computing power required.

It may also be the case that the operating parameter of the road paver comprises information on the material temperature upon delivery, which information is input in the control unit.

If the material, for example asphalt, is delivered by a truck, this material will usually already have been heated to a certain temperature, which is specified in the scope of delivery and can be entered manually in the control unit, e.g., by an operator, or can be fed to the control unit by scanning a delivery note. Also, this is an "operating parameter", since it identifies the condition of the material upon delivery. When this temperature is known to the control unit, the heating power of the heating element can then advantageously be controlled in such a way that the temperature of the screed plate will lie approximately in a range around the temperature of the material and/or, knowing this temperature, it will be possible to estimate the temperature which the material will still have when it arrives at the screed plate. As has already been explained above, this material temperature may then have added thereto an offset, i.e., a $\Delta T>0K$, in order to reliably prevent the material from adhering to the screed plate.

It may also be the case that the operating parameter of the surroundings comprises an ambient temperature.

The ambient temperature, i.e., the temperature of the air, for example, may advantageously be incorporated in the determination of the target temperature of the screed plate and does not require any additional components, since this temperature is usually already determined by road pavers.

According to an embodiment, the control unit determines from the material temperature upon delivery and from the ambient temperature a material temperature of the material that arrives at the screed plate, and the control unit adjusts the target temperature depending on the material temperature determined.

This combines in an advantageous manner the embodiments that have already been described.

It may also be the case that, for determining the target temperature, the control unit makes use of information stored in a memory assigned to the control unit.

These items of information may concern, for example, temperatures required for a particular material and they may vary from one material to the next, so that the control unit can be provided with the necessary information.

A road paver according to the present disclosure, used for laying material onto a subgrade, may comprise a material hopper, a paving screed and a delivery system for delivering material from the material hopper to the paving screed, wherein the paving screed is configured for laying material onto the subgrade and wherein the paving screed comprises a screed plate and a heating element for heating the screed plate, wherein the road paver comprises a temperature sensor for measuring a temperature of the screed plate and a control unit configured for controlling the temperature of the heating element, wherein the road paver is configured for executing a method according to one of the preceding embodiments.

The road paver is able to realize the advantageous characteristics of the methods described in the preceding embodiments.

DETAILED DESCRIPTION

Figure 1:
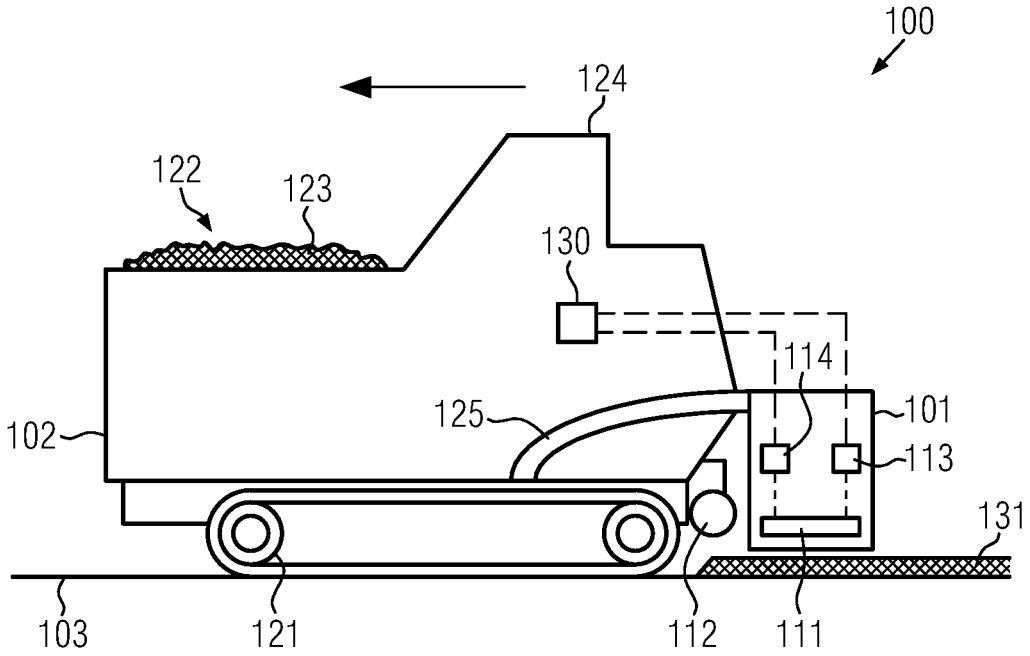
FIG. 1 shows a schematic representation of a road paver according to an embodiment.

FIG. 1 shows a road paver 100 according to an embodiment of the present disclosure. In the present embodiment, the road paver is substantially configured such that it comprises a vehicle part (also referred to as tractor unit) 102 and a paving screed 101.

In the embodiment shown here, the vehicle part 102 comprises, among other things, a driver's stand 124 on which, for example, the driver of the road paver 100 can sit. Also operating elements may be provided there, by way of example, so as to allow the driver to operate the road paver.

In addition, the road paver 100 is provided with a material hopper 122, also referred to as material bunker, in the vehicle part 102. The material 123, such as asphalt, to be laid on the road is stored therein in order to be kept available for further transport or use.

Not shown in detail here is a delivery system, which is arranged in the vehicle part 102 and which delivers the material from the material hopper 122 (or material bunker) to the paving screed 101. The delivery system may include, for example, a conveyor (e.g., scrapper conveyor) configured to move material from the material hopper 122 to or toward the paving screed 101.

The paving screed 101 is connected to the vehicle part 102 via connections (usually towing bars) 125 (which may be attached to both sides of the vehicle part 102), which are sufficiently known from the prior art, and may be supported, e.g., via one or a plurality of leveling cylinders (not shown here), in a particular orientation relative to the subgrade 103 on which the road paver is traveling.

In addition, the vehicle part 102 usually comprises a drive unit 121, which may be configured in the form of a chain drive, for example, so as to allow a movement of the road paver 100 on the subgrade 103.

In front of the paving screed 101, the road paver 100 usually comprises, on the one hand, an auger 112 by means of which the material is applied to the subgrade 103. This auger belongs to the vehicle part 102, and thus is not structurally part of the subsequent paving screed. The auger 112 may be considered part of the above-mentioned delivery system, and may receive material from the above-mentioned conveyor, for example. On the other hand, the paving screed comprises one or a plurality of screed plates 111, the paving screed having, due to its own weight, a smoothing and compacting effect on the material applied to the subgrade 103.

All the parts of the road paver 100 that have been described so far may be provided in this form or in a modified form, and are therefore to be understood merely as examples of the present disclosure. According to the present disclosure, the road paver 100 comprises at least one paving screed with a screed plate and a control unit.

In order to prevent the material from adhering to the screed plate and thus a negative effect on the paving result, the screed plate has associated therewith a heating element 113 according to the present disclosure. This heating element is arranged and configured such that it can heat the screed plate, and can in particular purposefully temper it to a specific temperature by supplying heat.

In addition, the screed plate 111 has associated therewith a temperature sensor 114, which can measure the temperature of the screed plate.

In view of the fact that the heating element usually supplies a heat quantity to the screed plate, the temperature of the screed plate is not yet known on the basis of the possibly known heat quantity alone, since the temperature also depends e.g., on the further heat transfer from the screed plate to e.g., the material applied to the subgrade 103. If this material has already cooled down substantially, e.g., through contact with the subgrade 103 or with the ambient air, or at least has a lower temperature compared with the temperature of the screed plate, different temperatures for the screed plate may be reached, when a certain amount of heat is supplied, depending on the temperature of the material and the associated heat transfer from the screed plate to the material or vice versa. In order to effectively prevent the material from adhering to the screed plate, the temperature of the screed plate should, however, always be higher than or at least equal to the temperature of the material.

This is the reason why the temperature sensor 114, which measures the temperature of the screed plate, is provided. This temperature sensor may, for example, be an electrically operating sensor or any suitable temperature sensor.

According to the present disclosure, a control unit 130 is additionally provided, which, only for the purpose of illustration, is here arranged in the vehicle part 102 and connected both to the sensor 114 and to the heating element for the purpose of data exchange (e.g., with the aid of cables and/or with the aid of wireless communication means).

According to the present disclosure, some embodiments are so conceived that the temperature sensor 114 measures the temperature of the screed plate over a certain period of time (either in the switched-on or in the switched-off condition of the heating element 113) and that, depending on the temperature profile of the screed plate measured over time, the control unit 130 subsequently (in particular after a determination of the temperature of the material 131) controls the heating element 113 in such a way that the screed plate is heated to a desired target temperature, and is in particular kept at the target temperature (e.g., with due regard to a permissible temperature window, for example in the event that the heating unit 113 is operated cyclically).

Alternatively, it may also be the case that the control unit takes into account one or a plurality of (additional) operating parameters, which are taken into consideration in determining the target temperature of the screed plate, such as the ambient temperature, the temperature of the material 123 upon delivery or the surface temperature of the road surface.

Particularly preferred are embodiments in the case of which it is not necessary to modify existing road pavers with respect to the sensors used, so as to carry out the method disclosed by the present disclosure according to one of the embodiments yet to be described. In particular, it is intended to provide a possibility of changing over road pavers, without sensors for measuring the temperature of the material itself, by providing suitable control programs for the control unit 130 in order to realize the method according to the present disclosure.

Preferred embodiments of the method are shown as flow charts in FIGS. 2 to 4 and will be explained in more detail hereinafter.

Figure 2:
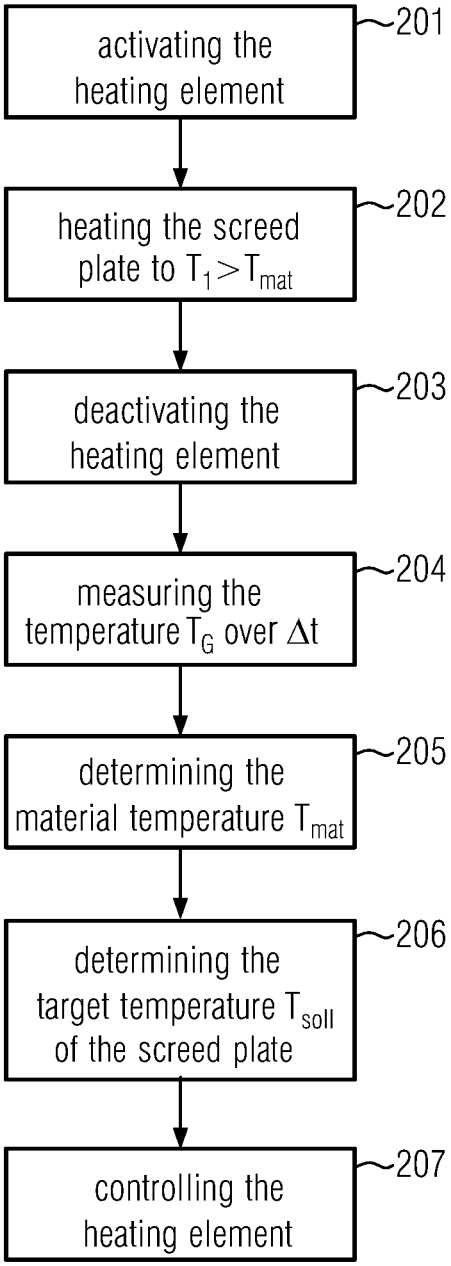
FIG. 2 shows a flowchart of a method according to an embodiment.

FIG. 2 shows an embodiment in the case of which conclusions with respect to the material temperature are drawn from the cooling behavior of the screed plate.

The method starts with the activation of the heating element for heating the screed plate. Preferably, this takes place before any material is laid on the subgrade or comes into contact with the screed plate. In step 202, the screed plate is first heated to a temperature $T_1$ that is higher than the temperature of the material to be laid on the subgrade. However, the temperature of the material $T_{mat}$ is not yet known in step 202. Heating of the screed plate can therefore be carried out to a temperature $T_1$ which is at least higher than the maximum mix temperature (material temperature) of about 180° C., i.e., about $T_1$=200° C. This will then ensure that, independently of the actual material temperature, the temperature $T_1$ of the screed plate in step 202 will be higher than the material temperature $T_{mat}$.

When the temperature $T_1$ has been reached, the heating element is deactivated in step 203 so that no more heat will be supplied from the heating element to the screed plate and the screed plate will start to cool down.

At this time, however, material is already fed to the paving screed 101, so that the material also comes into contact with the screed plate, the screed plate giving off heat to the material. In so doing, the screed plate will cool down.

Under the simplified assumption that the material temperature $T_{mat}$ remains constant (i.e., the material can be regarded as a heat reservoir with a constant temperature), the following holds true for the change in heat Q, transferred to the material, over time t $$\frac{dQ}{dt} = -c\frac{dT}{dt}$$

However, for the heat flow, the following holds true for any given time: $dQ/dt=a(T_1-T_2)$, where $T_1$ and $T_2$ are the temperatures of the objects involved in the heat exchange.

In the end, this has the effect that the following holds true for the temperature of the screed plate as a function of time $$T(t) = (T_0 - T_{mat})e^{-Bt} + T_{mat}$$

The constant B is here insignificant, but is conditioned by the material characteristics of e.g., the screed plate (in particular its size and contact area with the mix) and of the material and the mix, respectively.

From this, the temperature of the material $T_{mat}$ can be determined at least approximately.

To this end, the temperature of the screed plate is measured over a certain time Δt. The profile of the curve can then be used for drawing conclusions with respect to the material temperature $T_{mat}$, which is subsequently calculated in step 205.

Once this temperature is known, the desired target temperature $T_{soll}$ of the screed plate can be determined in a next step 206. This target temperature will be used to control the heating element in the subsequent step 207.

In step 206, the determination of the target temperature $T_{soll}$ can be carried out such that the screed plate has at least a slightly higher temperature than the material, so that $T_{soll}>T_{mat}$ can be selected. It may, for example, be the case that the temperature of the screed plate is about 10K higher than the actual material temperature. In determining or ascertaining the target temperature of the screed plate in step 206, a range of temperatures may also be specified as a "target temperature". For example, it may be the case that the temperature of the screed plate is not adjusted to a specific temperature value, but to a temperature range between a (maximum) target temperature $T_{soll}$ and the actual material temperature $T_{mat}$, so that the temperature of the screed plate should be within this range in any case.

In step 207, the control unit will then control the heating element (e.g., by supplying more or less power or by activating and/or deactivating it) in such a way that the temperature of the screed plate corresponds to the target temperature or is within the specified temperature range for the screed plate. This will prevent the mix from adhering to the screed plate.

This is preferably done within the framework of a closed-loop control cycle which, in principle, is known from the prior art and in which, based on a measured temperature value of the screed plate (for this purpose, the temperature sensor 114 may be used, by way of example), the control unit controls the heating element 113 and the temperature is then measured again by the temperature sensor 114 and the heating element is controlled again, and so on.

This allows, especially with the boundary condition of maintaining the temperature within a certain temperature window between a maximum target temperature and the material temperature, a reliable control of the temperature of the screed plate.

In FIG. 2, an embodiment has been described, in which the initial temperature of the screed plate is higher than the temperature of the material.

However, embodiments are also imaginable, in which the initial temperature (at which the measurement of the temperature of the screed plate over a certain time interval is started) is lower than the temperature of the material.

An embodiment of this kind will now be described in FIG. 3.

Figure 3:
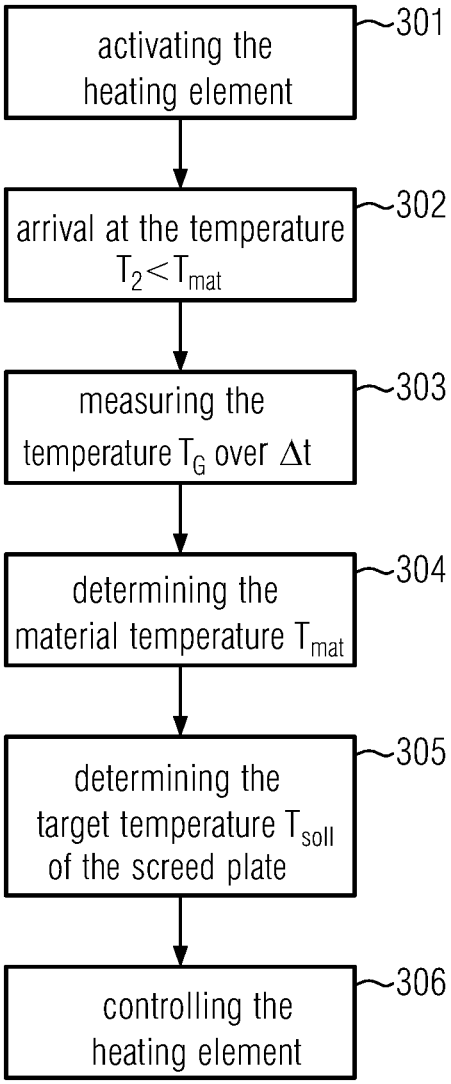
FIG. 3 shows a flowchart of a method according to a further embodiment.

In the embodiment shown in FIG. 3, the heating element is first activated in step 301, analogously to step 201.

However, this heating phase of the screed plate is only executed up to a temperature $T_2<T_{mat}$, whereupon the measurement of the temperature $T_G$ of the screed plate over a certain time interval Δt in step 303 is started.

In this context, the material can then be regarded as a heat reservoir with a higher temperature and the heating element as a heat reservoir for the screed plate with a second constant temperature. The temperature of the heating element and the heat provided thereby should here exceed the temperature of the material, in particular the heating element should have a higher temperature than the material.

Analogously to the above calculation, the respective steps for adding the heat transfer, which is carried out by both the material and the heating element, lead to a time dependence of the temperature. However, in this case it can preferably be utilized that in the relation $dQ/dt=a(T_1-T_2)$, a change of sign occurs as soon as $T_1$ changes from a temperature lower than $T_2$ to a temperature higher than $T_2$. For the embodiment described here, the following holds true for the change in heat over time: $dQ/dt=a(T_G-T_{mat})+b(T_G-T_H)$, $T_{mat}$ indicates here the material temperature and $T_H$ indicates the temperature of the heating element, T being the temperature of the screed plate as a function of time. The quantities a and b are constants. The temperatures $T_{mat}$ and $T_H$ can here be considered to be constant in time.

Since $T_{mat}<T_H$, there will be a kink in the time profile of the heat quantity (in particular in its derivative) as soon as the temperature $T_G$ of the screed plate exceeds the temperature $T_{mat}$ of the material, since from this moment in time onwards the material will no longer give off heat to the screed plate, but the screed plate will begin to give off heat to the material.

From this equation, the material temperature $T_{mat}$ can now be determined by measuring the temperature of the screed plate over a certain time when the jump in the derivative is detected, so that the material temperature $T_{mat}$ can again constitute the output variable for defining the target temperature $T_{soll}$ of the screed plate and controlling the heating element accordingly by the control unit in steps 304 to 306.

The course of action in steps 304 to 306 corresponds to the course of action according to steps 205 to 207, the equation to be solved according to FIG. 3 being then used instead of the equations indicated with respect to FIG. 2.

The remaining course of action is, however, analogous here. In particular, it may also here be the case that the heating element is controlled in a suitable manner for bringing the temperature of the screed plate to a target temperature, which is higher than the material temperature $T_{mat}$ or is at least in a range between a maximum target temperature and the material temperature, so that the material is prevented from adhering to the screed plate.

Also in this case, a suitable control loop may be used, which causes closed-loop control of the temperature by controlling the heating element such that the temperature is within the desired range.

The embodiments of FIGS. 2 and 3 may also be used competitively. For example, if the material temperature is not known, the screed plate may first be heated to a temperature $T_0$. If the temperature then drops in response to deactivation of the heating element, it can be determined that the temperature is $T_0>T_{mat}$ and the method according to FIG. 2 can be executed. If, in response to deactivation of the heating element, it turns out that the screed plate continues to heat up, the temperature is $T_0<T_{mat}$ and the method according to FIG. 3 can be executed.

Figure 4:
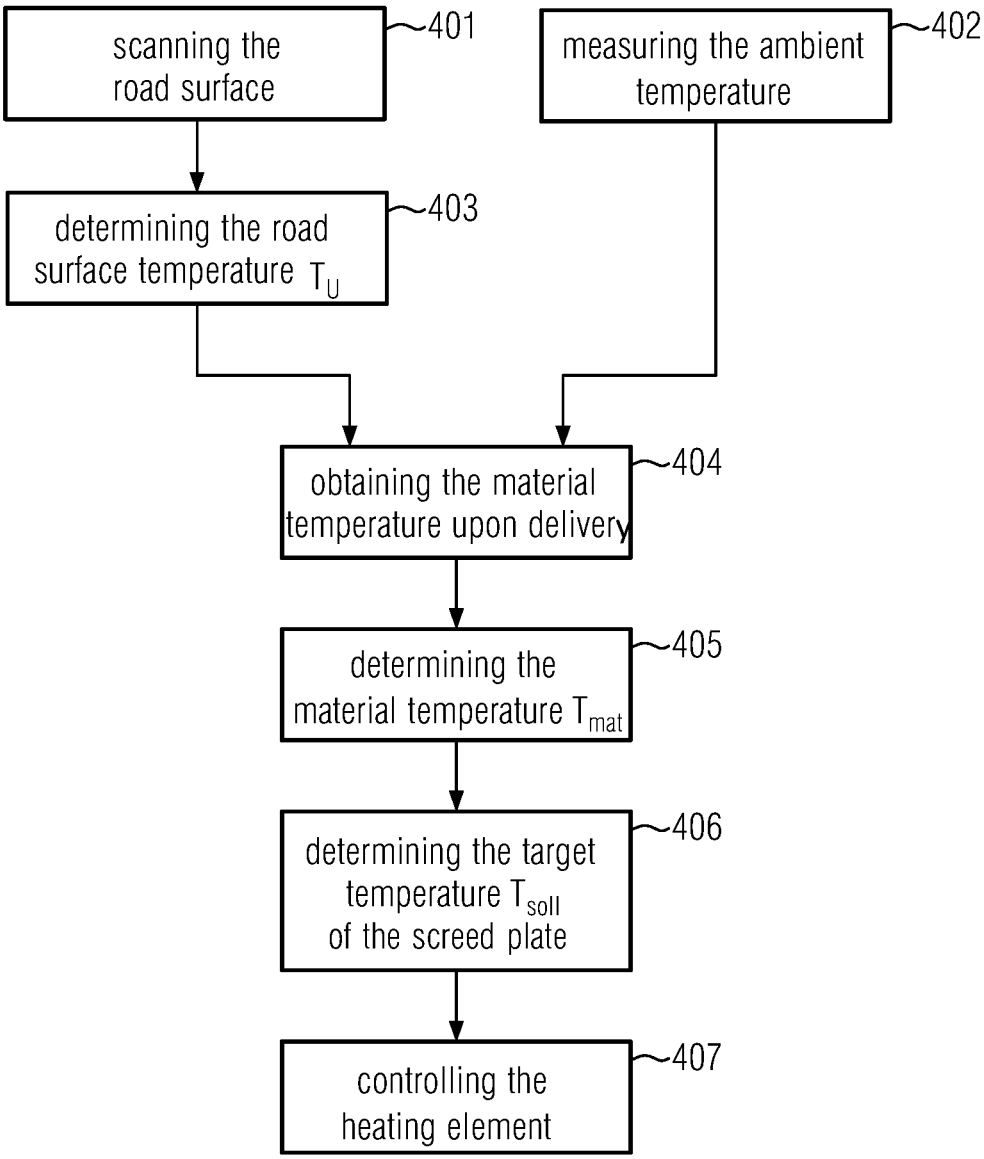
FIG. 4 shows a flowchart according to another embodiment.

In the case of a further embodiment according to FIG. 4, which is alternative to the preceding methods, the material temperature in the area of the screed plate is determined on the basis of at least one operating parameter and/or one operating parameter characterizing the surroundings and/or one operating parameter characterizing the road surface, so as to carry out control of the heating element.

To this end, FIG. 4 initially shows two methods that are alternative to one another or can be used in parallel; in the first method, scanning of the road surface is carried out in step 401 after the material has been laid. Corresponding methods are already known and comprise, inter alia, the measurement of the subgrade temperature, so that in step 403 the road surface temperature $T_S$ can be determined from the scanning of the road surface 401 behind the road paver. This road surface temperature is, in the final analysis, the temperature of the laid material.

Alternatively or additionally, the control unit can, for example, access usually provided temperature sensors for measuring the ambient temperature and thus measure the ambient temperature at a specific moment in time and/or obtain a value indicative therefor.

The road surface temperature $T_S$ and the ambient temperature, or one of them, can then be combined together with a value of the material temperature $T_{mat}$ upon delivery of the material to the road paver obtained in step 404, although this is not necessary and although it would also suffice to take into account for the further method only the material temperature $T_{mat}$ upon delivery. Alternatively, also the road surface temperature $T_S$ may be used as an indication for the material temperature $T_{mat}$ by assuming that the road surface temperature, as measured in step 401, is considered to be equal to the material temperature $T_{mat}$.

The material temperature upon delivery may, for example, be entered in a delivery note and may then be provided to the control unit by an operator, e.g., via a suitable input unit, such as a keyboard. Alternatively or additionally, the temperature in question may also be read out (free from error) by means of a barcode scanner or a QR code scanner, which is capable of detecting a respective code on the delivery note in which the temperature is encoded, and made available to the control unit.

From this material temperature, which the material has upon delivery (to the material bunker of the road paver), the temperature of the material in the area of the screed plate can then be extrapolated. This extrapolation can be determined with high accuracy, if the road surface temperature $T_S$ from step 403 and/or the ambient temperature from step 402 is/are available, since the cooling behavior of the material can be determined comparatively accurately. Alternatively, the delivery temperature may also be assumed to correspond, in principle, to the temperature of the material when the screed plate passes. The material temperature is thus known, and it will suffice to assume the target temperature to be either equal to or slightly higher than the material temperature.

If the material temperature upon delivery is not known, i.e., if step 404 is either not executable because the information is not available or not intended to be carried out, a "standard value", which is assumed for the material temperature upon delivery, can be used for calculating. Taking into account the ambient temperature from step 402 and/or the road surface temperature $T_S$ from step 403, it will then nevertheless be possible to draw approximate conclusions with respect to the material temperature in the area of the screed plate.

On the basis of this material temperature $T_{mat}$, which can be determined in step 405 according to the embodiments just described, the target temperature $T_{soll}$ for the screed plate is then determined in step 406. The target temperature can be specified analogously to the above embodiments, e.g., such that it is higher than the estimated material temperature (e.g., 10K, 15K, or 20K) and/or such that the temperature of the screed plate is between a maximum target temperature and the estimated material temperature.

Based on this target temperature or the corresponding range for the temperature of the screed plate, the heating element is then controlled by the control unit in step 407 in accordance with the control loop already described.

For all the above-mentioned embodiments, further information may be taken into account in order to determine the target temperature of the heating element. For example, for determining the target temperature it may be taken into account what kind of material layer is applied to the subgrade, e.g., a binder layer or a surface layer, and a target temperature can be adjusted depending thereon, since different materials may entail different demands with respect to the maximum heat supplied thereto, or should not be heated beyond a limit temperature. Therefore, in order to avoid adhesion of the material to the screed plate on the one hand and excessive heating of the material on the other, the temperature will also in this embodiment preferably be adjusted such that it is only slightly higher than the estimated material temperature. Such information can be made available to the control unit via a memory, which may be assigned to the control unit. It can be stored in this memory, e.g., in the form of one or a plurality of data structures, such as tables, and can be retrieved by the control unit when the target temperature is to be determined.

For example, also the formulas of the individual mixes may be specified as the information in question, or it may be specified what is the maximum temperature range within which the temperature of the mix in the area of the screed plate may vary, in order to determine therefrom the target temperature of the screed plate.

While the preceding embodiments of FIGS. 2 to 4 are described substantially alternatively to one another, it may also be the case that at least the embodiments of FIGS. 2 and 3 are combined with the embodiment of FIG. 4.

The embodiment of FIG. 4 allows, in the final analysis, even without measuring the temperature of the screed plate, to specify a target temperature for the screed plate and to subsequently control the heating element in order to achieve the temperature in question.

If the temperature sensor for measuring the temperature of the screed plate according to the embodiments of FIGS. 2 and 3 fails, the method described in FIG. 4 may be used without a control loop, e.g., in that the control unit uses information stored in a memory and concerning the amount of heat required for heating the screed plate to a certain temperature, without a downstream control loop that allows to check whether this temperature is actually reached, so as to control the heating element 113 (cf. FIG. 1) in a suitable manner. The heating element can then be controlled to output approximately an amount of heat that is typically sufficient for adjusting the temperature of the screed plate to e.g., 155° C. (again, any other value may be used for the target temperature). Thus, in the event that the temperature sensor fails, the target temperature of the screed plate can be controlled at least roughly, i.e., less precisely than with the embodiments of FIGS. 2 and 3, in order to prevent the material from adhering to the screed plate. In this way, the functionality of the road paver can be maintained with this combination of embodiments, even if a possibly provided temperature sensor should fail.

As one skilled in the art would understand, the control unit (e.g., the control unit 130) may include suitable hardware and software, such as one or more processors (e.g., one or more microprocessors, microcontrollers and/or programmable digital signal processors) in communication with, or configured to communicate with, one or more storage devices or media including computer readable program instructions that are executable by the one or more processors so that the control unit may perform particular algorithms represented by the functions and/or operations described herein. The control unit may also, or instead, include one or more application specific integrated circuits, programmable gate arrays or programmable array logic, programmable logic devices, or digital signal processors.

What is claimed is:

1. A method for adjusting a temperature of a screed plate of a paving screed of a road paver, the method comprising:

heating the screed plate with a heating element of the paving screed;

measuring temperature of the screed plate over a time interval using a temperature sensor; and adjusting a target temperature of the heating element, depending on a time profile of the temperature of the screed plate, using a control unit of the road paver.

2. The method according to claim 1, wherein the screed plate is heated to a first temperature by the heating element and the heating element is subsequently deactivated and the screed plate is brought into contact with material that is being laid onto a subgrade, and wherein a material temperature is determined by the control unit from the time profile of the temperature of the screed plate after deactivation of the heating element and the target temperature is determined depending on the material temperature.

3. The method according to claim 2, wherein the control unit determines the target temperature from the material temperature by increasing the material temperature by a differential value.

4. The method according to claim 1, wherein the heating element heats the screed plate to a heat-up temperature, which is lower than a material temperature of material that is being laid onto a subgrade, and, subsequently, the screed plate is brought into contact with the material while the heating element heats the screed plate, and wherein the material temperature is determined by the control unit from the time profile of the temperature of the screed plate while the screed plate is being heated by the heating element and is in contact with the material, and the target temperature is determined depending on the material temperature.

5. The method according to claim 4, wherein the control unit determines the target temperature from the material temperature by increasing the material temperature by a differential value.

6. The method according to claim 1, wherein, for adjusting the target temperature, the control unit makes use of information stored in a memory assigned to the control unit.

7. A method for adjusting a temperature of a screed plate of a paving screed of a road paver, the method comprising:

heating the screed plate with a heating element of the paving screed; and determining, using a control unit of the road paver, a target temperature of the heating element taking into account an operating parameter of the road paver and/or of surroundings and/or of a road surface, wherein, for determining the target temperature, the control unit makes use of information stored in a memory assigned to the control unit, wherein the information comprises a material temperature of material at delivery of the material to the road paver, wherein the material temperature is received by the control unit via an input unit that is configured to receive input from a user and/or wherein the material temperature is received by the control unit via a barcode scanner or a QR code scanner which is operable to detect a code on a delivery note in which the temperature is encoded.

8. The method according to claim 7, wherein the operating parameter comprises a surface temperature of the road surface that has been determined during a temperature scan.

9. The method according to claim 7, wherein the operating parameter of the surroundings comprises an ambient temperature.

10. The method according to claim 7, wherein the material temperature is received by the control unit via the input unit.

11. The method according to claim 7, wherein the material temperature is received by the control unit via the barcode scanner or the QR code scanner.

12. The method according to claim 7, wherein the operating parameter of the road paver comprises information on material temperature upon delivery, which information is input in the control unit.

13. The method according to claim 12, wherein the operating parameter of the surroundings comprises an ambient temperature, and wherein the control unit determines from the material temperature upon delivery and from the ambient temperature a material temperature of material that arrives at the screed plate, and the control unit adjusts the target temperature depending on the material temperature determined.

14. A road paver for laying material onto a subgrade, the road paver comprising:

a paving screed configured for laying the material onto the subgrade, wherein the paving screed comprises a screed plate and a heating element for heating the screed plate;

a temperature sensor for measuring a temperature of the screed plate; and a control unit configured to control temperature of the heating element, wherein the control unit is operable to adjust a target temperature of the heating element depending on a time profile of the temperature of the screed plate; or the control unit is configured to determine a target temperature of the screed plate taking into account an operating parameter of the road paver and/or of surroundings and/or of a road surface, wherein, for determining the target temperature the control unit is configured to make use of information storable in a memory assigned to the control unit, wherein the information comprises a material temperature of material at delivery of the material to the road paver, wherein the material temperature is receivable by the control unit via an input unit that is configured to receive input from a user and/or wherein the material temperature is receivable by the control unit via a barcode scanner or a QR code scanner which is operable to detect a code on a delivery note in which the temperature is encoded.

15. The road paver according to claim 14, wherein the control unit is operable to adjust the target temperature of the heating element depending on the time profile of the temperature of the screed plate.

16. The road paver according to claim 14, wherein the control unit is configured to determine the target temperature of the screed plate taking into account the operating parameter of the road paver and/or of the surroundings and/or of the road surface.

17. The road paver according to claim 14, further comprising a material hopper for storing the material, and a delivery system for delivering the material from the material hopper to the paving screed.

18. The road paver according to claim 14, wherein the control unit is operable to receive the material temperature via the input unit.

19. The road paver according to claim 14, wherein the control unit is operable to receive the material temperature via the barcode scanner or the QR code scanner.

* * * * *